United States Patent [19]

Hakoyama et al.

[11] Patent Number: 4,638,624

[45] Date of Patent: Jan. 27, 1987

[54] FALSE TWIST CRIMPED YARN HAVING IMPROVED COHERENCY

[75] Inventors: Soichi Hakoyama, Kobe; Shigetatu Mori, Kanazawa; Yoshiyuki Takebe, Kanazawa; Kanya Imaoka, Kanazawa, all of Japan

[73] Assignees: Teijin Limited; Kitanihon Spinning Co., Ltd., both of Japan

[21] Appl. No.: 554,406

[22] Filed: Nov. 22, 1983

[30] Foreign Application Priority Data

Nov. 22, 1982 [JP] Japan ..... 57-203681

[51] Int. Cl.[4] ..... D01H 7/92; D02G 1/06; D02G 3/38

[52] U.S. Cl. ..... 57/208; 57/247; 57/284; 57/344

[58] Field of Search ..... 57/247, 246, 283, 284, 57/287, 288, 344, 205, 208, 207

[56] References Cited

U.S. PATENT DOCUMENTS

| | | | |
|---|---|---|---|
| 2,949,721 | 8/1960 | Van Dijk | 57/344 X |
| 2,985,995 | 5/1961 | Bunting | 57/204 |
| 3,116,588 | 1/1964 | Breen | 57/293 |
| 3,691,750 | 9/1972 | Waters | 57/288 X |
| 3,710,565 | 1/1973 | Schnegg et al. | 57/247 X |
| 3,842,581 | 10/1974 | Schedler | 57/344 |
| 4,060,970 | 12/1977 | Talbot | 57/205 |
| 4,070,815 | 1/1978 | Negishi et al. | 57/208 |
| 4,103,481 | 8/1978 | Vukoje | 57/288 X |
| 4,115,988 | 9/1978 | Nakagawa et al. | 57/247 X |
| 4,169,349 | 10/1979 | Talbot | 57/247 X |

FOREIGN PATENT DOCUMENTS

| | | | |
|---|---|---|---|
| 70143 | 6/1977 | Japan | 57/247 |

*Primary Examiner*—Stuart S. Levy
*Assistant Examiner*—Joseph J. Hail, III
*Attorney, Agent, or Firm*—Sughrue, Mion, Zinn, Macpeak, and Seas

[57] ABSTRACT

The present invention provides a false twist crimped yarn having an improved coherent structure which is produced by the specific mode of processing realized by defining the processing conditions of false twist crimping system. Here the unitary effect generally takes the form of a structure in which several of the yarn composing filaments fasciate the rest of the filaments and accordingly the false twist crimped yarn can be submitted to the weaving process without undergoing the sizing, twisting and interlacing required conventionally.

6 Claims, 6 Drawing Figures

FALSE TWIST CRIMPED YARN HAVING IMPROVED COHERENCY

FIELD OF THE INVENTION

The present invention relates generally to a false twist crimped yarn, and more particularly to a false twist crimped yarn which, having a remarkably improved coherency, can be directly supplied to the weaving process without being subjected to a twisting, sizing, or interlacing treatment beforehand.

DESCRIPTION OF THE PRIOR ART

In the conventional method of weaving a fabric from a false twist crimped yarn, it is necessary to give a unitary or coherent property to the yarn, and accordingly such preparatory treatments as sizing or twisting are indispensable for organizing the yarn into a usable end construction for fabric forming, thus making the weaving process much complicated. To eliminate such intermediate procedures, a new art of interlacing the yarn has been introduced to impart coherency to the same, which usually follows the false twist crimping process in one continuous operation. Since this interlacing process has the merit of giving sufficient coherency to the yarn at the same rate of processing speed as the false twist crimping process, it is now widely utilized. However, the interlacing process has its own disadvantages in that its air jet costs much and the management and handling of its interlacing nozzles and both the intraspindle and interspindle quality control demand special skill and care. Also, the interlacing process is placed under a strictly separate system from the false twist crimping process and accordingly it is far from satisfactory from the view point of rationalization.

OBJECT OF INVENTION

It is an object of the present invention to provide a false twist crimped yarn having an improved coherent effect which eliminates those processes of sizing, twisting and interlacing which are necessarily introduced into the weaving system independent of the false twist crimping process as described in the above.

SUMMARY OF THE INVENTION

As the result of an exhaustive study to achieve the abovementioned object, the inventors of the present invention have come to find that a novel yarn structure having an excellent coherency without adversely influencing the primary performance of a false twist crimped yarn can be obtained by delicately changing the tension of the yarn and specifically creating a balloon structure at the untwisted portions formed recurrently along the length of the yarn while the yarn makes one revolution on its lengthwise axis.

More specifically, this invention is to provide a false twist crimped yarn containing at least one type of a coherent structure, which is selected from the undermentioned group consisting of four types of coherent structures, formed intermittently along the length of the yarn.

(a) A coherent structure formed by a group of filaments having a twist conforming to the false twist and another group of filaments having a twist opposed to the false twist being intermingled with each other:

(b) A coherent structure formed by a bundle of filaments having a twist conforming to the false twist being bound spirally by several filaments wrapping in the direction opposite to the false twist:

(c) A coherent structure formed by a bundle of filaments substantially having no twist being bound spirally by several filaments wrapping in the direction opposite to the false twist: and (d) A coherent structure formed by a bundle of filaments substantially having no twist being bound spirally by several filaments wrapping in the direction conforming to the false twist.

BRIEF DESCRIPTION OF THE DRAWINGS

FIG. 1, the (a) structure, corresponds to (a) of the aforementioned interwined structures (a) to (d); FIG. 1, (b), to the (b) structure; FIG. 1, (c) to the (c) structure; and FIG. 1, (d), to the (d) structure respectively.

DESCRIPTION OF THE PREFERRED EMBODIMENTS

Figure 1A:
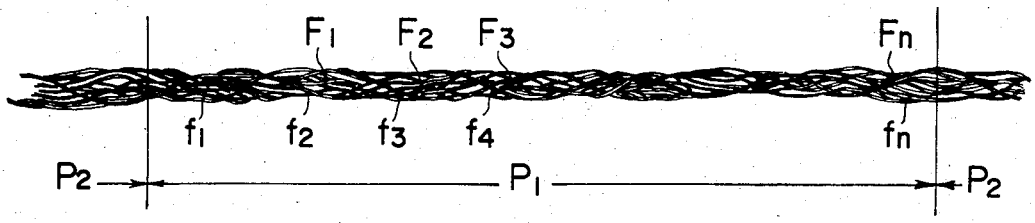
FIG. 1, (a) to (d), present side views of the false twist crimped yarns (Z false twist) of the present invention to especially show the side views of the respective portions of a coherent structure ($P_1$) of the yarns.
Figure 1B:
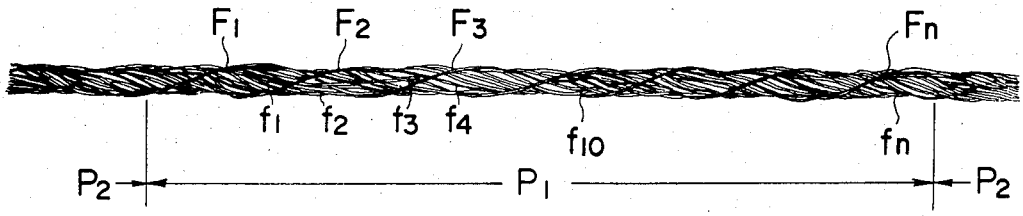
Figure 1C:
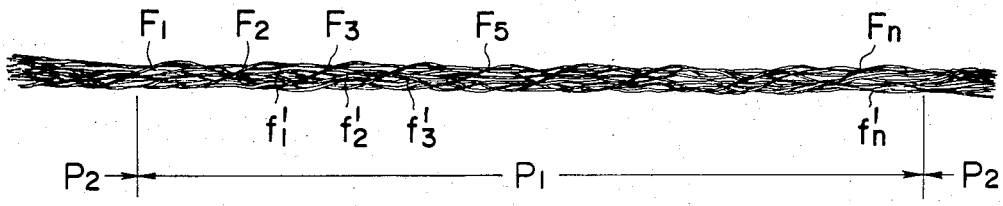
Figure 1D:
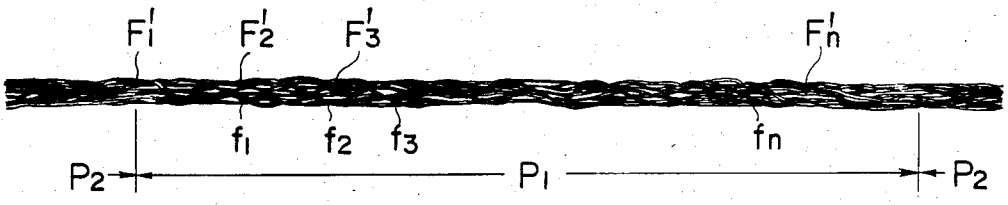

In FIG. 1, (a), those groups of filaments $f_1$, $f_2$, $f_3$, —$f_n$ all having a twist (Z) conforming to the false twist (Z) and those groups of filaments $F_1$, $F_2$, $F_3$, —$F_n$ all having a twist (S) opposite to the false twist are intermingled with each other, thus forming a portion of a coherent structure $P_1$. While in FIG. 1, (b), a bundle of filaments consisting of a bundle of filaments $f_1$, $f_2$, —$f_n$ apparently forms an aggregation (what is called a not untwisted portion) having a twist (Z) conforming to the false twist. This aggregation of filaments is bound spirally by smaller groups of several (at most 5 or less) filaments $F_1$, $F_2$, —$F_n$ wrapping in the direction of S twist opposite to the false twist to form a bound structure. In FIG. 1, (c), a bundle of filaments ($f_1'$, $f_2'$, —$f_n'$) substantially having no twist is bound spirally by several filaments ($F_1$, $F_2$, —$F_n$) wrapping in the direction of S twist opposite to the false twist to form a coherent structure bound like the preceding (b). Furthermore, in FIG. 1, (d), shows a coherent structure which is always found in the false twisted crimped yarn of the present invention. A bundle of filaments ($F_1'$, $F_2'$, —$F_n'$) substantially having no twist is bound spirally by several filaments ($f_1'$, $f_2'$, —$f_n$) wrapping in the direction of Z twist conforming to the false twist to form a kind of a coherent structure like the preceding (c).

The characteristic common to FIG. 1, (a) to (d), is that, in all the coherent structures, some of the yarn composing filaments fasciate the rest of the filaments (which are not untwisted partially or completely) wrapping spirally in the direction conforming or opposing the false twist to form a coherent structure. In the prior art, a simple consecutive S/Z structure is found with a false-twist melt-bound yarn; however, in the case of the present invention, S twist filaments coexist with Z twist filaments in the same portion to form a coherent structure, which may be called a novel structure of false twist crimped yarn quite different from the conventional ones.

When the false twist crimped yarn of the present invention is examined closely through a microscope, it is confirmed that one or more than one of the aforementioned four types of coherent structures (a), (b), (c) and (d), are found existing alternately at successive intervals along the length of the yarn. These coherent structures are respectively formed in lengths of 2 to 20 mm and at intervals of 2 to 300 mm in general. The loose or non-unitary structures $P_2$ lying between the adjacent coherent structures $P_1$ is bigger in apparent thickness than the coherent structures and, from this point of view, the loose structure may be called an opened structure; however, it may be especially stressed that many of these loose structures have some degree of interlacing effect among their composing filaments.

The abovementioned false twist crimped yarn can be obtained by delicately changing the tension under which the yarn flows between the parts of the false twister, by causing particular but minute variations of twist to be inserted, and by forming a multiballoon structure on the yarn after it passes through the false-twist spindle. An explanatory description is made hereunder as to the process of making the false twist crimped yarn where the falsetwist spindle is used, for instance.

Figure 2:
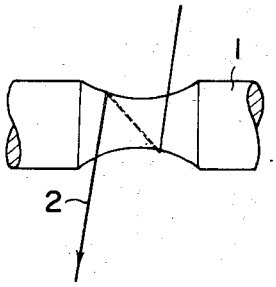
FIG. 2 is a front view showing how the yarn is made to pass around the twist pin of the false-twist spindle in obtaining the false twist crimped yarn of the present invention.
Figure 3:
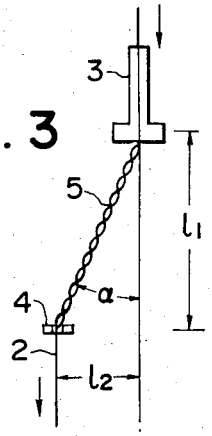
FIG. 3 is a schematic sketch showing how the multiballoon structure is formed on the yarn while it is flowing between the false-twist spindle and the yarn guide situated on the lower course of the yarn flow in obtaining the false twist crimped yarn of the present invention.

Firstly, a means must be contrived to make the yarn pass around the twist pin in such a way as to keept the yarn off the center of the twist pin when it comes into and then gets out of contact with the twist pin, or a twist pin which is designed to work with the flowing yarn in such a way as mentioned above must be used. Secondly, a yarn guide must be located at a position not distant from the twist pin so that a multiballoon structure may be formed on the yarn while it passes between the twist pin and the yarn guide. FIG. 2 shows how the first of the abovementioned requirements is to be satisfied. Here the flowing yarn 2 is false twisted while it passes around the twist pin 1, where the yarn is kept off the center of the twist pin when it comes into and gets out of contact with the twist pin. However, this is an unsteady process for the yarn because the flowing yarn is naturally forced to shift its course along the axis of the twist pin on its concave surface while the twist pin turns on its axis and the resulting apparent zigzag running around the twist pin brings about changes in the tension of the yarn to cause uneven twist holding. This is not enough to produce a coherent structure having the ability of holding together as proposed by the present invention. It is, therefore, suggested to satisfy the second of the aforementioned requirements according to FIG. 3, where a multiballoon pattern 5 is formed to magnify the false twist effect produced in the preceding false twisting. In FIG. 3, the numeral 3 indicates a false-twist spindle, 4 a yarn guide, $l_1$ the distance in a straight line between the twist pin and the yarn guide on the central axis of the false-twist spindle, $l_2$ the eccentric distance between the yarn guide and the central axis of the false-twist spindle, and $\alpha$ the angle of bend made by the yarn flow with the central axis of the false-twist spindle.

It is advisable to set the abovementioned $l_1$ within the range of 10 to 100 mm, $l_2$ 5 to 35 mm, and $\alpha$30 degrees or less. Under the conditions like these, the coherent structures can be formed at a rate ranging from 10 to 50 structures per 80 cm.

The processing performance required of the interlacing process which is free of twisting and sizing treatments is generally said to maintain a minimum confounding point of 30 interlaced structures per 80 cm. When a false twist crimped yarn which has the same number of coherent structures as mentioned above is to be made according to the present invention, the value of $l_2$ should be so determined as to make the angle of bend $\alpha$ less than 25 degrees while setting the value of $l_1$ within the range of 35 to 100 mm. Incidentally, the values of $l_1$ and $l_2$ adopted in the ordinary false twisting and crimping process are as low as 3 to 5 mm for the former and 0 to 1 mm for the latter.

The reason why the coherent structures like the aforementioned (a), (b), (c) or (d) can be formed when the preceding two conditions are satisfied has not yet been made clear; however, it is assumed that the formed multiballoon structure makes the effect of holding the twist more unsteady and causes the non-uniform twist to spread in the untwisted parts of the yarn, thus allowing part of the filaments to separate from and intertwine with the rest.

It has been confirmed that a more desirable false twist crimped yarn which never fails to have the coherent structures (d) inserted therein, with coexistence of at least one additional coherent structure selected from a group consisting of the coherent structures (a), (b), and (c), by carefully defining the processing conditions with regard to the abovementioned false twisting conditions. More concretely, such a false twist crimped yarn like this can be obtained by adopting the value $l_1$ of more than 100 mm (upper limit is about 150 mm), the value $l_2$ of less than 20 mm (lower limit is about 7 to 8 mm), and the value $\alpha$ of 10 degrees or less.

Under the abovementioned conditions, yarns will be made to have the coherent structures ranging from 30 to 55 per 80 cm. The processing performance required of the interlacing process free of twisting and sizing treatments generally satisfies the minimum confounding point of 30 interlaced structures per 80 cm. Incidentally, the values of $l_1$ and $l_2$ adopted in the ordinary false twist crimping process are as low as 3 to 5 mm for the former and 0 to 1 mm for the latter.

No restriction is placed on the kind of filaments to be used for preparing the false twist crimped yarn according to the present invention so far as they are thermoplastic; however, filaments made from polyester, especially polyethylene terephthalate, and those make from polyamide, especially poly-$\epsilon$-capramide, are used preferably in general.

The false twist crimped yarn of the present invention has an original and profound significance in that it is produced to have a coherent effect during the false twist crimping process without adopting any additional means to impart the unity to the yarn such as interlacing, sizing, etc. Furthermore, the coherent structures inserted in said false twist crimped yarn display an effect of an improved running and handing property corresponding to the "entangled portion" formed in an interlaced yarn as described in the following Examples and the false twist crimped yarn thus obtained can be made into fabrics which are by no means inferior in quality to those made of conventional interlaced yarns.

By way of illustration, but not by way of limitation, the following examples are given to illustrate the practice of this invention. As a matter of course, various modifications of the abovedescribed preferred embodiments of this invention will be apparent to those skilled in the art, and it is to be understood that such modifications can be made without departing from the scope of the invention, if within the spirit and tenor of the accompanying claims.

EXAMPLE 1

Polyethylene terephthalate chips having the intrinsic viscosity of 0.64 were melt-spun in the usual way through the spinnerette having 36 holes and taken up at the rate of 3,200 m/min to give a semioriented yarn of 115 denier/36 filaments.

The obtained yarn was then subjected to the in-draw false twist texturing process by use of a false twister, modified LS-6 model, manufactured by Mitsubishi Heavy Industries, Ltd., at a processing temperature of 190° C. and draw ratio of 1.51, wherein the yarn was made to pass around the twist pin in such a way as to keep the yarn off the center of the twist pin when it comes into and gets out of contact with the twist pin. The processing conditions and the result are shown in Table 1.

TABLE 1

| NO. | Central part of twist pin (FIG. 2) | Position of guide $l_1$ (mm) | $l_2$ (mm) | $\alpha$ (°) | False twist tension $T_2$ | $T_1$ | Number of intertwined structures* |
|---|---|---|---|---|---|---|---|
| 1 | 1.5 R (radius of curvature) × 0.7ϕ (diameter) | 85 | 5 | 0 | 32 | 18 | 30.1 |
| 2 | 1.5 R (radius of curvature) × 0.7ϕ (diameter) | 95 | 5 | 2.5 | 32 | 18 | 37 |
| 3 | 1.5 R (radius of curvature) × 0.7ϕ (diameter) | 95 | 10 | 5.5 | 32.5 | 18 | 42.3 |
| 4 | 1.5 R (radius of curvature) × 0.7ϕ (diameter) | 95 | 20 | 11.5 | 32.5 | 17 | 37.3 |
| 5 | 1.5 R (radius of curvature) × 0.7ϕ (diameter) | 95 | 30 | 17.0 | 33 | 18.5 | 36.3 |
| 6 | Eccentric spindle reverse threading | 95 | 15 | 9.5 | 33 | 18 | 39.3 |
| 7 | 1.5 R × 0.7ϕ | 37 | 15 | 21.5 | 34 | 19 | 47 |

*About 80% is occupied by the coherent structures (c).

Measurement of coherent structures:

The respective specimens were obtained in a length of 80 cm. They were elongated by 3% and were then released to a length of 60 cm under which state the number of the coherent structures was counted. The measurement was made with 5 specimens of the respective yarns and the average number was obtained therefrom.

EXAMPLE 2

In order to confirm the of coherency effect and handling property of the false twist crimped yarn No. 2 obtained in Example 1, a plain weave fabric having a density of 84 warps/inch and 73 fillings/inch using said yarn as warps and fillings with the use of Nissan water jet loom LW 41 model operated at a rate of 410 rpm. For the sake of comparison, the false twist crimped yarn No. 2 was subjected to the interlacing process to make an interlaced yarn having 40 interlaced portions per 80 cm and the same kind of woven fabric was made therefrom.

During the weaving operation, the occurrence of fluff and breakage on the warp yarns during the warping process and the shedding condition and the frequency of the suspension of the weaving machine were examined and the result is shown in Table 2.

TABLE 2

| Yarn | Warping process Fluff | Breakage | Shedding condition | Weavability (Suspension of machine) |
|---|---|---|---|---|
| Yarn of this invention | times/$10^6$ m 0.03 | times/$10^6$ m 0.01 | Good | times/ weaver · day 3~5 |
| Interlaced yarn | 0.03 | 0.01 | Good | 3~5 |

As apparently seen from Table 2, it is confirmed that the false twist crimped yarns of this invention compare favorably with conventional interlaced yarns in workability, weavability, etc.

EXAMPLE 3

A false twist crimped yarn was obtained according to Example 1, wherein the processing temperature of 190° C., drawing ratio of 1.51, distance $l_1$ of 105 mm, distance $l_2$ of 15 mm, angle of bend $\alpha$ of 3 degrees, twisting tension of 32 g and untwisting tension of 17 g were adopted. It was confirmed that the obtained yarn had some coherent structures (a) and (c) and also a few coherent structures (b) in addition to the coherent structures (d) which mainly composed the yarn.

EXAMPLE 4

The false twist crimped yarns obtained in Example 3 were woven into a fabric according to Example 2.

On this occasion, the occurence of fluff and breakage on the warp yarns during the warping process and the shedding condition and the frequency of the suspension of the weaving machine were examined and the result is shown in Table 3.

TABLE 3

| Yarn | Warping process Fluff | Breakage | Shedding condition | Weavability (Suspension of machine) |
|---|---|---|---|---|
| Yarn of this invention | times/$10^6$ m 0.03 | times/$10^6$ m less than 0.01 | Good | times/ weaver · day 3~5 |
| Interlaced | 0.03 | 0.01 | Good | 3~5 |

TABLE 3-continued

| Yarn | Warping process | | Shedding condition | Weavability (Suspension of machine) |
|---|---|---|---|---|
| | Fluff | Breakage | | |
| yarn | | | | |

It has been confirmed positively from Table 3 that the false twist crimped yarns of the present invention are equal to conventional interlaced yarns in workability, weavability, etc.

What we claim is:

1. A false twist crimped yarn comprised of a single false twist crimped yarn having a loose structure and consisting essentially in filaments having substantially the same characteristics and having a plurality of spaced apart coherent structures of smaller thickness than said loose structure wherein at least one of said coherent structures is comprised of a bundle of filaments having substantially no twist and is bound spirally by several wrapping filaments in a direction conforming to the false twist with said wrapping filaments being part of said single yarn and said bundle of filaments being the remaining filaments of said single yarn and at least one co-existing additional coherent structure is comprised of a different configuration.

2. A false twist crimped yarn as set forth in claim 1 wherein said additional coherent structure is formed by a group of filaments having a twist conforming to the false twist and another group of filaments having a twist opposite to the false twist being intermingled with each other with both groups of filaments being part of said single yarn.

3. A false twist crimped yarn as set forth in claim 1 wherein said additional coherent structure is formed by a bundle of filaments having a twist conforming to the false twist being bound spirally by several filaments wrapping in a direction opposite to the false twist with both groups of filaments being part of said single yarn.

4. A false twist crimped yarn as set forth in claim 1 wherein said additional coherent structure is formed by a bundle of filaments substantially having no twist being bound spirally by several filaments wrapping in a direction opposite to the false twist with both groups of filaments being part of said single yarn.

5. A false twist crimped yarn as set forth in claim 1 wherein said coherent structures are formed in excess of 30 per 80 cm.

6. A false twise crimped yarn as set forth in claim 1 wherein said coherent structures are the sole means for maintaining the coherency of the single false twist crimped yarn.

* * * * *